US007018602B2

(12) United States Patent
Yanagisawa et al.

(10) Patent No.: US 7,018,602 B2
(45) Date of Patent: Mar. 28, 2006

(54) CARBON FIBER FOR FIELD ELECTRON EMITTER AND METHOD FOR MANUFACTURING FIELD ELECTRON EMITTER

(75) Inventors: Takashi Yanagisawa, Tokyo (JP); Morinobu Endo, 615 Kitahara-cho, Suzaka-shi, Nagano-ken (JP)

(73) Assignees: GSI Creos Corporation, Tokyo (JP); Morinobu Endo, Suzaka (JP)

( * ) Notice: Subject to any disclaimer, the term of this patent is extended or adjusted under 35 U.S.C. 154(b) by 256 days.

(21) Appl. No.: 10/098,396

(22) Filed: Mar. 18, 2002

(65) Prior Publication Data

US 2002/0136682 A1 Sep. 26, 2002

(30) Foreign Application Priority Data

Mar. 21, 2001 (JP) ..... 2001-081748
Aug. 29, 2001 (JP) ..... 2001-260428
Feb. 22, 2002 (JP) ..... 2002-046950

(51) Int. Cl.
*D01F 9/12* (2006.01)

(52) U.S. Cl. ..... 423/447.2; 423/447.1; 428/367; 427/77; 427/78

(58) Field of Classification Search ..... 423/447.1, 423/447.2, 445 R; 428/367; 427/77, 78
See application file for complete search history.

(56) References Cited

U.S. PATENT DOCUMENTS 5,698,175 A * 12/1997 Hiura et al. ..... 423/447.1
5,780,101 A * 7/1998 Nolan et al. ..... 427/216
5,872,422 A 2/1999 Xu et al. ..... 313/311
6,087,765 A 7/2000 Coll et al. ..... 313/309
6,506,355 B1 * 1/2003 Glasgow et al. ..... 423/447.3
2003/0004058 A1 * 1/2003 Li et al. ..... 502/258

FOREIGN PATENT DOCUMENTS

EP 0198558 A2 * 10/1986
EP 1 122 344 A2 8/2001
EP 1 187 161 A2 3/2002
WO WO 00/54300 9/2000
WO WO 01/93292 12/2001
WO WO 02/30816 4/2002

OTHER PUBLICATIONS

U.S. Appl. No. 10/098,375, filed Mar. 18, 2002, Yanagisawa et al.
U.S. Appl. No. 10/098,416, filed Mar. 18, 2002, Yanagisawa et al.
U.S. Appl. No. 10/098,351, filed Mar. 18, 2002, Yanagisawa et al.
U.S. Appl. No. 10/098,461, filed Mar. 18, 2002, Yanagisawa et al.
U.S. Appl. No. 10/098,440, filed Mar. 18, 2002, Yanagisawa et al.

(Continued)

*Primary Examiner*—Tom Dunn
*Assistant Examiner*—Peter J. Lish
(74) *Attorney, Agent, or Firm*—Oliff & Berridge, PLC

(57) ABSTRACT

A carbon fiber for a field electron emitter has a coaxial stacking morphology of truncated conical tubular graphene layers, each of which includes a hexagonal carbon layer and has a large ring end and a small ring end at opposite ends in the axial direction. The edges of the hexagonal carbon layers are exposed on at least part of the large ring ends. Since all the exposed edges function as electron emission tips, a large amount of emission current can be obtained.

8 Claims, 21 Drawing Sheets

OTHER PUBLICATIONS

U.S. Appl. No. 10/098,103, filed Mar. 18, 2002, Yanagisawa et al.
U.S. Appl. No. 10/098,522, filed Mar. 18, 2002, Yanagisawa et al.
U.S. Appl. No. 10/098,379, filed Mar. 18, 2002, Yanagisawa et al.
U.S. Appl. No. 10/098,312, filed Mar. 18, 2002, Yanagisawa et al.
U.S. Appl. No. 10/098,570, filed Mar. 18, 2002, Yanagisawa et al.
Endo et al., "Structural characterization of cup-stacked-type nanofibers with an entirely hollow core", Applied Physics Letters, vol. 80, No. 7, Feb. 18, 2002, pp. 1267-1269.
Kim et al., "Effect of ball milling on morphology of cup-stacked carbon nanotubes", Chemical Physics Letters, Apr. 2, 2002.
Blank, V. D. et al., "The Structure of Nanotubes Fabricated by Carbon Evaporation at High Gas Pressure", Carbon, Elsevier Science Publishing, New York, NY, vol. 38, No. 3, 2000, pp. 1217-1240.
Bangert, U. et al., "Nanocarbons Formed in a Hot Isotatic Pressure Apparatus", Thin Solid Films, Elsevier-Sequoia S.A. Lausanne, Ch, vol. 346, No. 1-2, pp. 86-90, Jun. 1, 1999.
Colbert, D. et al., "Fullerene Nanotubes for Molecular Electronics", Trends in Biotechnology, Elsevier, Amsterdam, NL, vol. 17, No. 2, pp. 46-50, Feb. 1999.
Endo, M. et al., "Pyrolytic Carbon Nanotubes from Vapor-Grown Carbon Fibers", Carbon, Elsevier Science Publishing, New York, NY, vol. 33, No. 7, pp. 873-881, 1995.
Zhang, X. B. et al., "The Texture of Catalytically Grown Coil-Shaped Carbon Nanotubles", Europhysics Letters, Les Ulis, FR, vol. 27, No. 2, pp. 141-146, Jul. 10, 1994.
Endo, M. "Stacking Nature of Graphene Layers in Carbon Nanotubes and Nanofibres", J. Phys. Chem, vol. 58, No. 11, pp. 1707-1712, 1997.

* cited by examiner

Prior Art

CARBON FIBER FOR FIELD ELECTRON EMITTER AND METHOD FOR MANUFACTURING FIELD ELECTRON EMITTER

This application is based on Japanese Patent Application No. 2001-81748 filed on Mar. 21, 2001, Japanese Patent Application No. 2001-260428 filed on Aug. 29, 2001, and Japanese Patent Application No. 2002-46950 filed on Feb. 22, 2002, the contents of which are incorporated herein by reference.

BACKGROUND OF THE INVENTION

The present invention relates to a carbon fiber for a field electron emitter and a method for manufacturing a field electron emitter.

Field emission from carbon nanotubes (CNTs) has been studied and utility thereof as a display material has been attracting attention.

It is necessary to obtain a strong field in order to achieve field emission. Therefore, the tip of an emitter material must be extremely sharp. CNTs have a large aspect ratio and sharp tips, are chemically stable and mechanically strong, and excel in stability at high temperatures. Therefore, CNTs are useful as the emitter material for field emission.

CNTs which have been studied include: (1) a multi-wall CNT (MWCNT) manufactured using an arc discharge in helium gas or the like, (2) a CNT produced by immersing single-wall CNTs (SWCNTs) manufactured using an arc discharge in hydrogen gas or the like in a solvent, and bundling the SWCNTs after drying, (3) a vapor grown carbon fiber, and the like.

These CNTs are formed into a cold cathode having a large area used for light emitting devices by securing a large number of CNTs on a substrate in the same direction using a screen printing process or the like.

However, the MWCNT and bundled SWCNT are unsuitable for mass production on an industrial scale and therefore increase cost.

On the contrary, the vapor grown carbon fiber can be mass-produced at a comparatively low cost.

Generally, the vapor grown carbon fiber has a structure in which hexagonal carbon layers are grown concentrically around the fiber axis, and opposite ends of the hexagonal carbon layers are closed. Therefore, in order to obtain emission of electrons, opposite ends of the hexagonal carbon layers must be opened using a complicated treatment. Since only the opened ends of such a carbon fiber function as emission tips for electrons, it is difficult to obtain a large number of electron emission tips. In order to obtain a large number of emission tips, it is necessary to perform a very difficult process such as an increase in the fiber diameter or formation of openings in an area other than opposite ends of the carbon fiber.

BRIEF SUMMARY OF THE INVENTION

The present invention has been achieved to solve the above-described problems. An object of the present invention is to provide a carbon fiber for a field electron emitter in which a large number of edges of graphene layers can be exposed and a greater amount of emission current can be obtained, and a method for manufacturing a field electron emitter.

In order to achieve the above object, one aspect of the present invention provides a carbon fiber for a field electron emitter comprising a coaxial stacking morphology of truncated conical tubular graphene layers, each of which includes a hexagonal carbon layer.

In other words, this carbon fiber for a field electron emitter has a cup-stacked structure or lampshade-stacked structure in which a number of hexagonal carbon layers in the shape of a cup having no bottom are stacked. The coaxial stacking morphology of the truncated conical tubular graphene layers may be formed in the shape of a hollow core with no bridge. According to such a structure, each of the truncated conical tubular graphene layers has a large ring end and a small ring end at opposite ends in the axial direction, wherein the hexagonal carbon layers are exposed on the large ring ends on the outer surface side and the small ring ends on the inner surface side. In other words, the edges of the tilted hexagonal carbon layers of the herring-bone structure are exposed in layers.

Common carbon fibers with a herring-bone structure have a structure in which a number of hexagonal carbon layers in the shape of a cup having a bottom are stacked. However, the carbon fiber according to one aspect of the present invention is hollow having no bridge at a length ranging from several tens of nanometers to several tens of microns.

In the case where the coaxial stacking morphology of the truncated conical tubular graphene layers is vapor grown, a wide area of the outer surface or the inner surface may be covered with deposited films of an excess amount of pyrolytic carbon. However, the edges of the hexagonal carbon layers are exposed on at least part of the large ring ends on the outer surface side or at least part of the small ring ends on the inner surface side.

The edges of the hexagonal carbon layers exposed on the outer surface or the inner surface of the carbon fiber have an extremely high degree of activity, exhibit good affinity to various types of materials, and excel in adhesion to composite materials such as resins. Therefore, a composite excelling in tensile strength and compressive strength can be obtained.

According to one aspect of the present invention, part or all of the deposited films formed on the outer surface or the inner surface during the vapor growth process of the carbon fiber for a field electron emitter may be removed by a subsequent treatment. Since these deposited films consist of an excess amount of insufficiently crystallized amorphous carbon, the surfaces of these deposited layers are inactive.

In the carbon fiber for a field electron emitter according to one aspect of the present invention, the large ring ends may be stacked in the axial direction to form the outer surface of the carbon fiber. In this case, the edges of the hexagonal carbon layers are preferably exposed on 2% or more of the outer surface, and still more preferably 7% or more of the outer surface.

The large ring ends on the outer surface of the carbon fiber for a field electron emitter may be positioned irregularly, so that the outer surface may have minute irregularities at a level of the size of atoms.

Similarly, the small ring ends may be stacked in the axial direction to form the inner surface of the carbon fiber. The small ring ends on the inner surface of the carbon fiber may be positioned irregularly, so that the inner surface may have minute irregularities at a level of the size of atoms.

According to one aspect of the present invention, all the hexagonal carbon layers exposed on the outer surface or the inner surface of the carbon fiber for a field electron emitter can function as electron emission tips, whereby electrons may be emitted at low voltage.

When the exposed edges form minute irregularities, an electric field is more easily concentrated on the exposed edges of the hexagonal carbon layers, whereby electrons may be emitted at low voltage.

Another aspect of the present invention provides a method for manufacturing a field electron emitter comprising the steps of dispersing the above carbon fibers for a field electron emitter in a dispersion medium, depositing the carbon fibers on an electrode by spraying, and drying the carbon fibers to form a carbon fiber layer.

In this case, the carbon fiber layer can be formed with good adhesion by forming a metal buffer layer on the electrode in advance, and forming the carbon fiber layer on the metal buffer layer.

DETAILED DESCRIPTION OF THE EMBODIMENT

An embodiment of the present invention is described below in detail with reference to the drawings.

A vapor grown carbon fiber is a short fiber in which carbon obtained by pyrolysis of hydrocarbons such as benzene or methane at a temperature of about 700 to 1000° C. is grown with a catalyst particle such as a ultra-fine iron particle or nickel as a nucleus.

Carbon fibers generally have a structure in which the hexagonal carbon layers are grown concentrically or a structure in which the hexagonal carbon layers are grown in the axial direction. However, depending upon the vapor growth conditions such as catalyst, temperature range, and flow rate, carbon fibers may have a herring-bone structure in which the stacked hexagonal carbon layers are tilted with respect to the fiber axis at an specific angle.

Common carbon fibers with a herring-bone structure have a structure in which a number of hexagonal carbon layers in the shape of a cup having a bottom are stacked. However, the carbon fiber formed by a vapor growth process used in one embodiment of the present invention has a structure in which a number of hexagonal carbon layers in the shape of a bottomless cup are stacked (this bottomless carbon fiber is hereinafter called "carbon fiber having a herring-bone structure").

Figure 21:
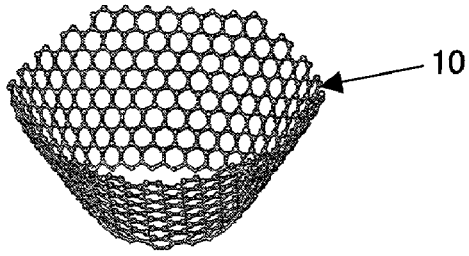
FIG. 21 is a view showing computer graphics of a hexagonal carbon layer, which is a unit of the coaxial stacking morphology of the truncated conical tubular graphene layers shown in FIG. 20, based on rigorous quantum theoretical calculation.
Figure 20:
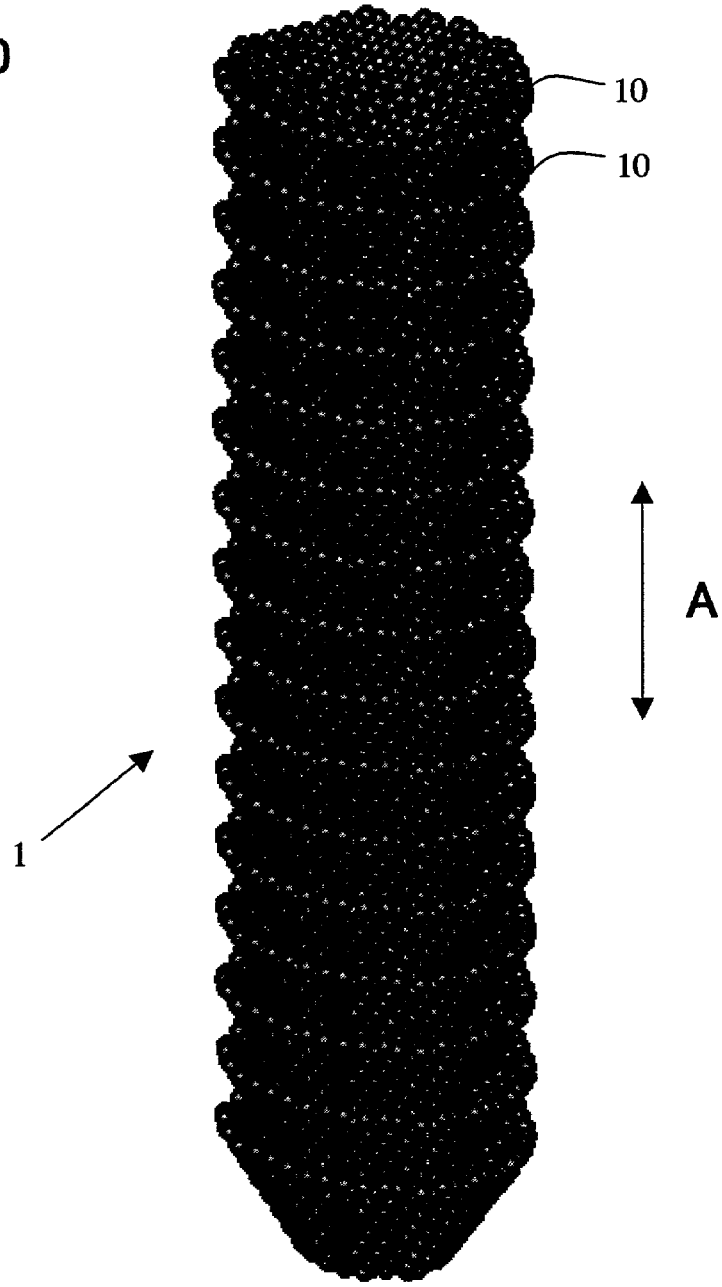
FIG. 20 is a view showing computer graphics of a coaxial stacking morphology of truncated conical tubular graphene layers based on rigorous quantum theoretical calculation.

Specifically, this carbon fiber has a coaxial stacking morphology of truncated conical tubular graphene layers shown by computer graphics in FIG. 20. Each of the truncated conical tubular graphene layers is formed of a hexagonal carbon layer 10 shown in FIG. 21. Although the actual hexagonal carbon layers 10 shown in FIG. 20 are stacked densely in an axial direction A, stacking density is roughly indicated in FIG. 20 for convenience of illustration.

Figure 22:
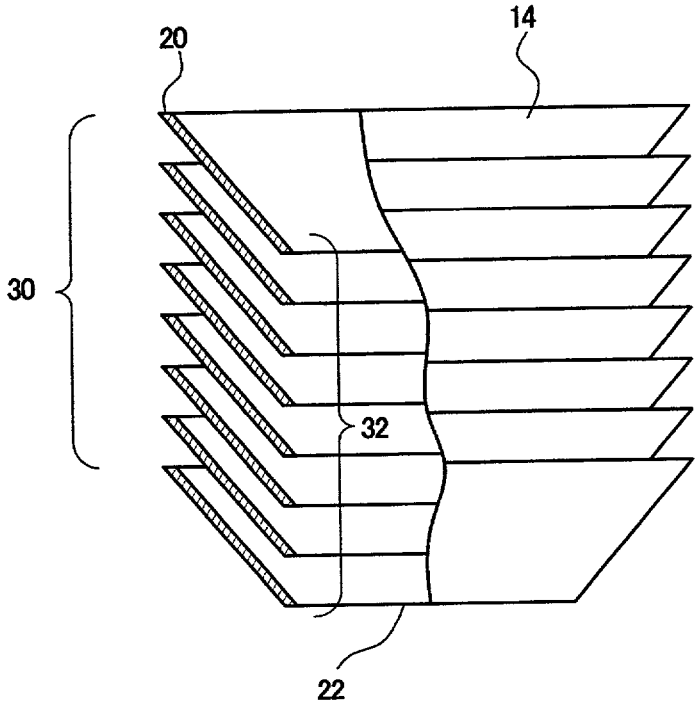
FIG. 22 is a schematic view for describing a large ring end and a small ring end which respectively form an outer surface and an inner surface of the coaxial stacking morphology of truncated conical tubular graphene layers.

FIG. 22 is a schematic view of FIG. 20. Each of the hexagonal carbon layers 10 has a large ring end 20 and a small ring end 22 at opposite ends in the axial direction. The large ring ends 20 are stacked in the axial direction A to form an outer surface 30 of the carbon fiber 1. The small ring ends 22 are stacked in the axial direction A to form an inner surface 32 of the carbon fiber 1. The carbon fiber 1 is in the shape of a hollow core with no bridge and has a center hole 14.

An example of a method for manufacturing the carbon fiber 1 shown in FIG. 20 is described below.

A conventional vertical type reactor was used.

Benzene as a raw material was fed to a chamber of the reactor using a hydrogen stream at a flow rate of 0.3 l/h and a partial pressure equivalent to the vapor pressure at about 20° C. Ferrocene as a catalyst was vaporized at 185° C. and fed to the chamber at a concentration of about $3\times10^{-7}$ mol/s. The reaction temperature and the reaction time were about 1100° C. and about 20 minutes, respectively. As a result, a carbon fiber having a herring-bone structure with an average diameter of about 100 nm was obtained. A hollow carbon fiber having no bridge at a length ranging from several tens of nanometers to several tens of microns, in which a number of hexagonal carbon layers in the shape of a bottomless cup are stacked, is obtained by adjusting the flow rate of the raw material and the reaction temperature (which are changed depending on the size of the reactor).

Figure 1:
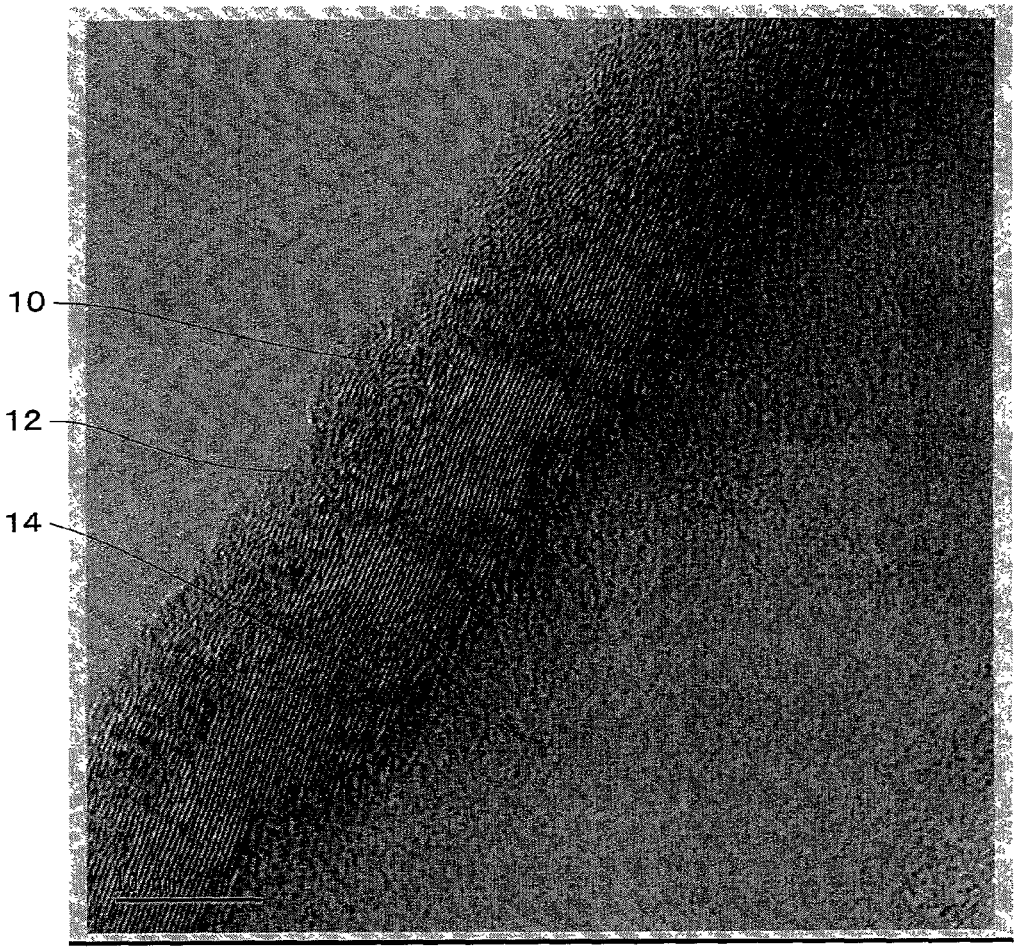
FIG. 1 is a view showing a copy of a transmission electron micrograph of a carbon fiber having a herring-bone structure manufactured using a vapor growth process.
Figure 2:
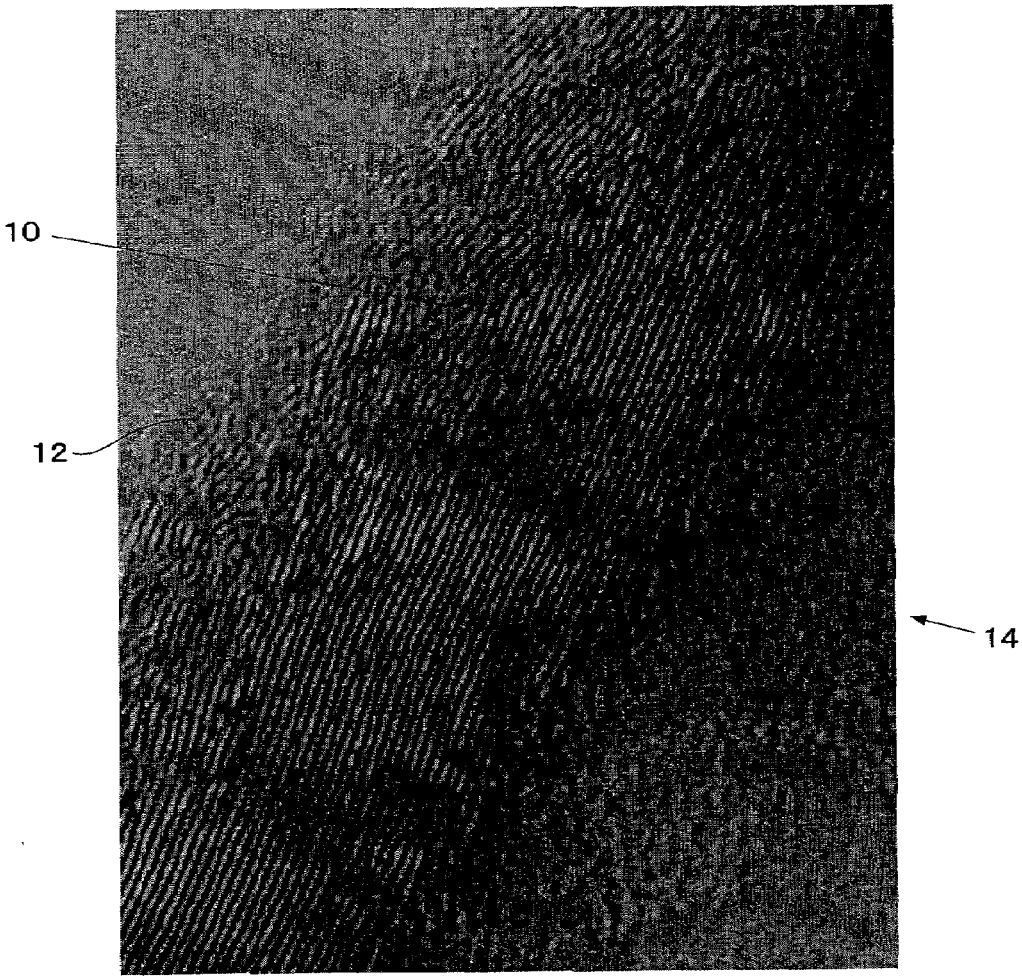
FIG. 2 is an enlarged view of FIG. 1.
Figure 3:
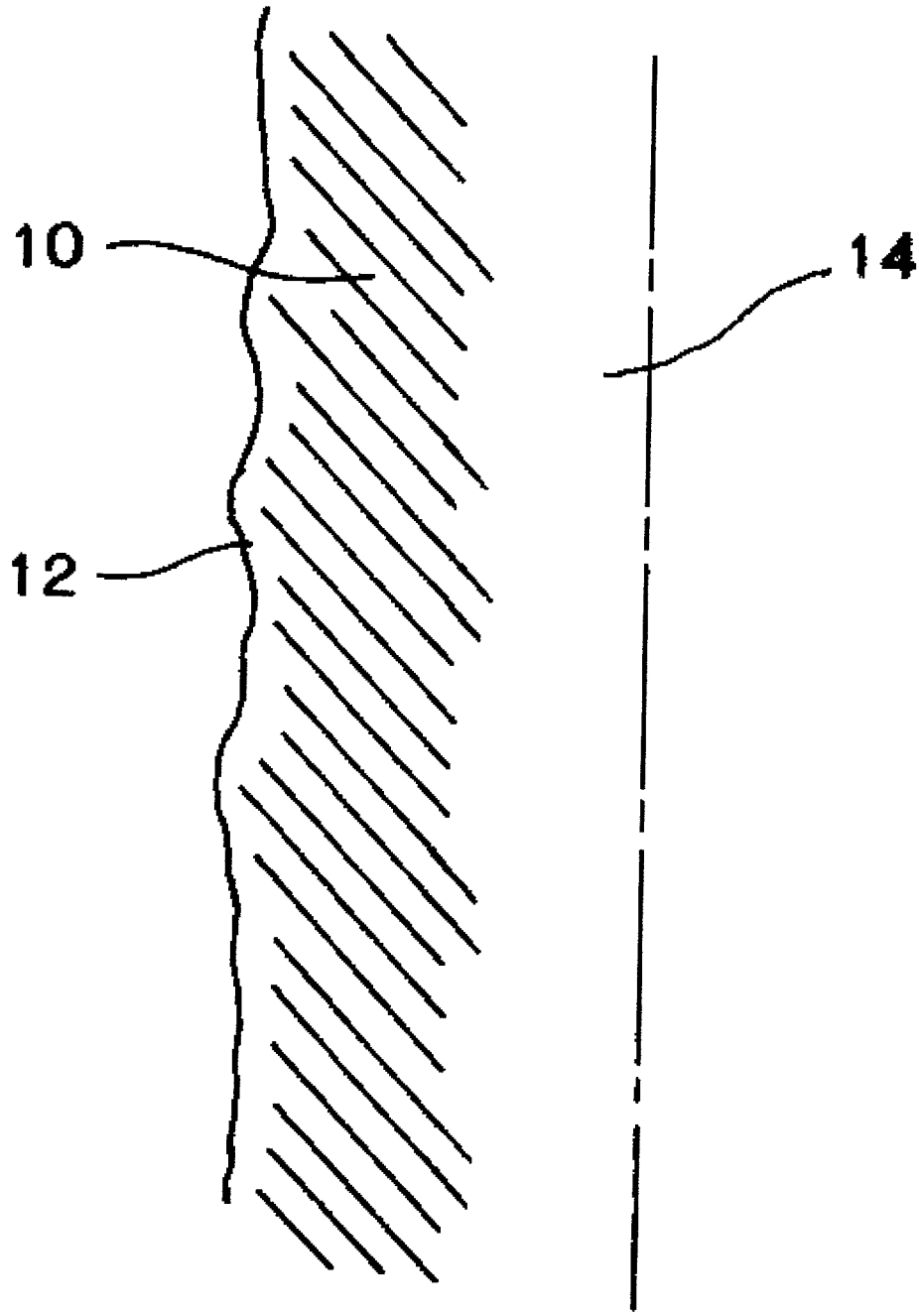
FIG. 3 is a schematic view of FIG. 2.

FIG. 1 is a view showing a copy of a transmission electron micrograph of the carbon fiber having a herring-bone structure manufactured using the vapor growth process. FIG. 2 is a view showing a copy of an enlarged photograph of FIG. 1, and FIG. 3 is a schematic view of FIG. 2.

As is clear from these figures, a deposited layer 12, in which an excess amount of amorphous carbon is deposited, is formed to cover the tilted hexagonal carbon layers 10. The formation of such a deposited layer 12 is inevitable when using the vapor growth process. The thickness of the deposited layer 12 is about several nanometers. The surface of the deposited layer 12 is inactive. A reference numeral 14 indicates the center hole.

Figure 23:
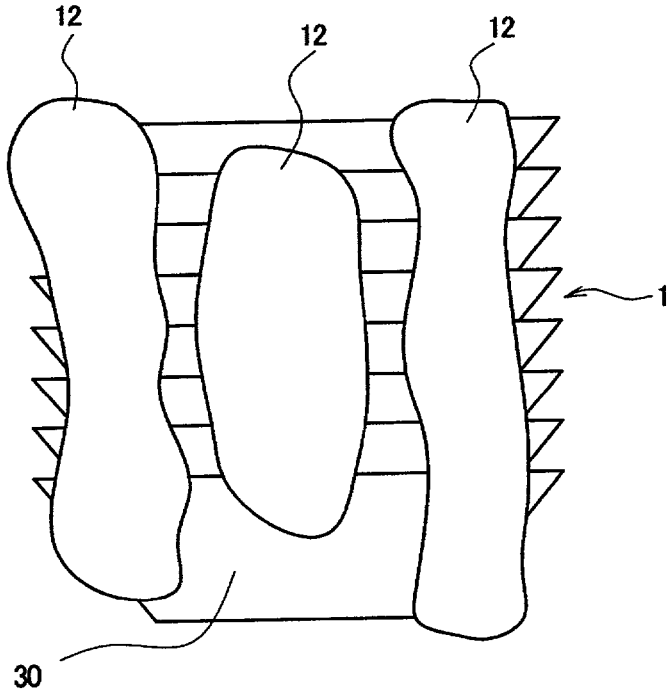
FIG. 23 is a schematic view for describing a deposited film of pyrolytic carbon formed over a wide range of an outer surface of a carbon fiber.

FIG. 23 is a view schematically showing a state in which the deposited films 12 are formed over a wide area of the outer surface 30 of the carbon fiber 1. As shown in FIG. 23, the edges of the hexagonal carbon layers 10 are exposed on the large ring ends 20 in the areas in which the outer surface of the carbon fiber 1 is not covered with the deposited films 12. These areas have a high degree of activity. In the area in which the inner surface of the carbon fiber 1 is not covered with the deposited films 12, the edges of the hexagonal carbon layers 10 are exposed on the exposed small ring ends 22.

The deposited layers 12 are oxidized and pyrolyzed by heating the carbon fiber on which the deposited layers 12 are formed at a temperature of 400° C. or more, preferably 500° C. or more, and still more preferably 520 to 530° C. for one to several hours in air. As a result, the deposited films 12 are removed, whereby the edges of the hexagonal carbon layers are further exposed.

The deposited layers 12 may be removed by washing the carbon fiber with supercritical water, whereby the edges of the hexagonal carbon layers may be exposed.

The deposited layers 12 may be removed by immersing the carbon fiber in hydrochloric acid or sulfuric acid and heating the carbon fiber at about 80° C. while stirring using a stirrer.

Figure 4:
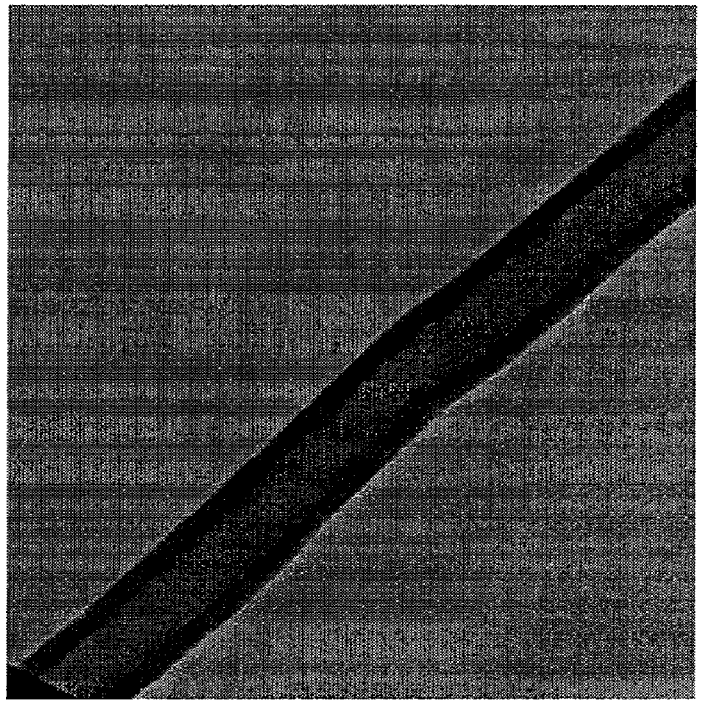
FIG. 4 is a view showing a copy of a transmission electron micrograph of a carbon fiber having a herring-bone structure heated at a temperature of about 530° C. for one hour in air.
Figure 5:
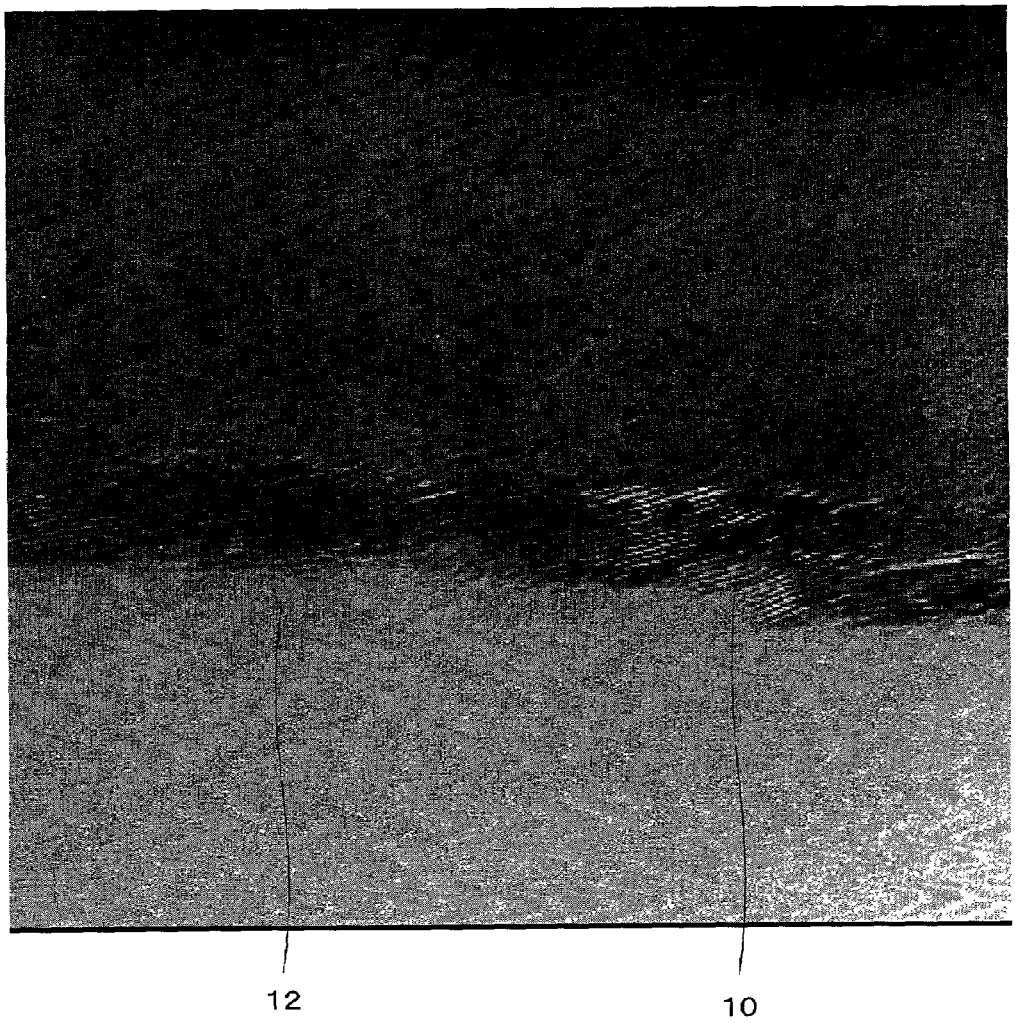
FIG. 5 is an enlarged view of FIG. 4.

FIG. 4 is a view showing a copy of a transmission electron micrograph of the carbon fiber having a herring-bone structure heated at a temperature of about 530° C. for one hour in air. FIG. 5 is a view showing a copy of an enlarged photograph of FIG. 4, FIG. 6 is a view showing a copy of an enlarged photograph of FIG. 5, and FIG. 7 is a schematic view of FIG. 6.

Figure 6:
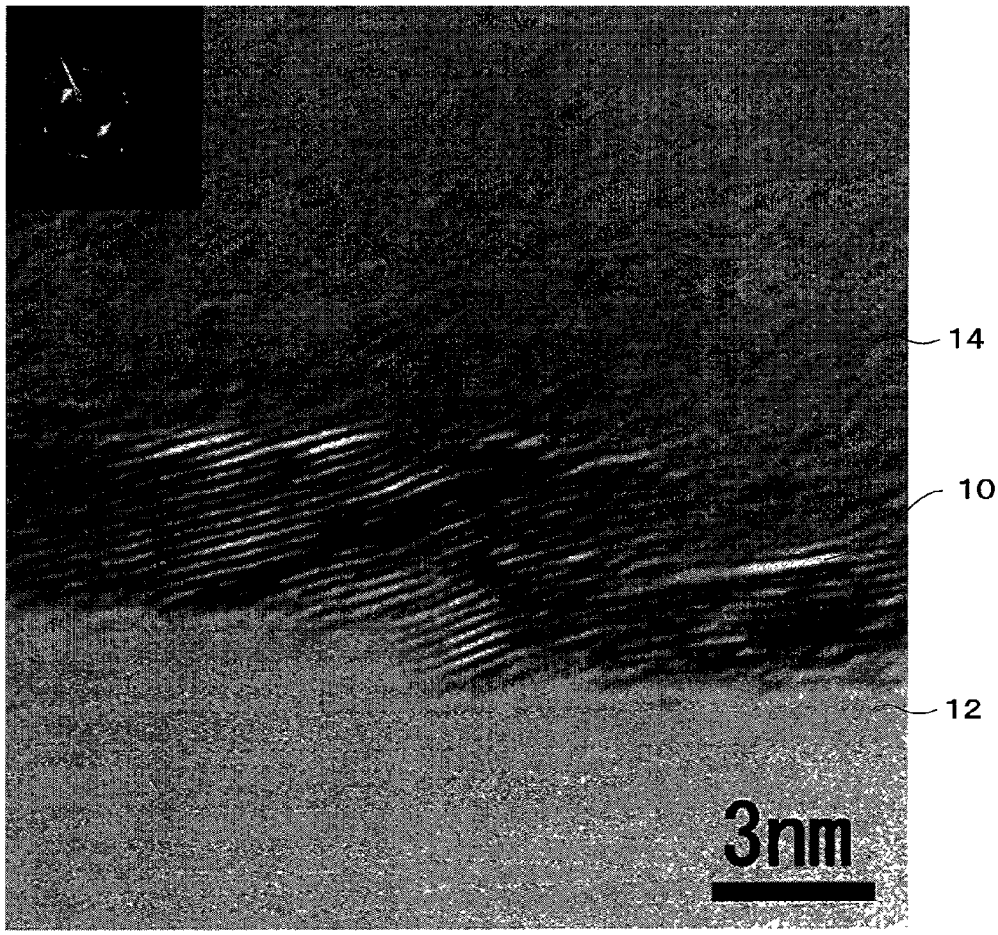
FIG. 6 is an enlarged view of FIG. 5.
Figure 7:
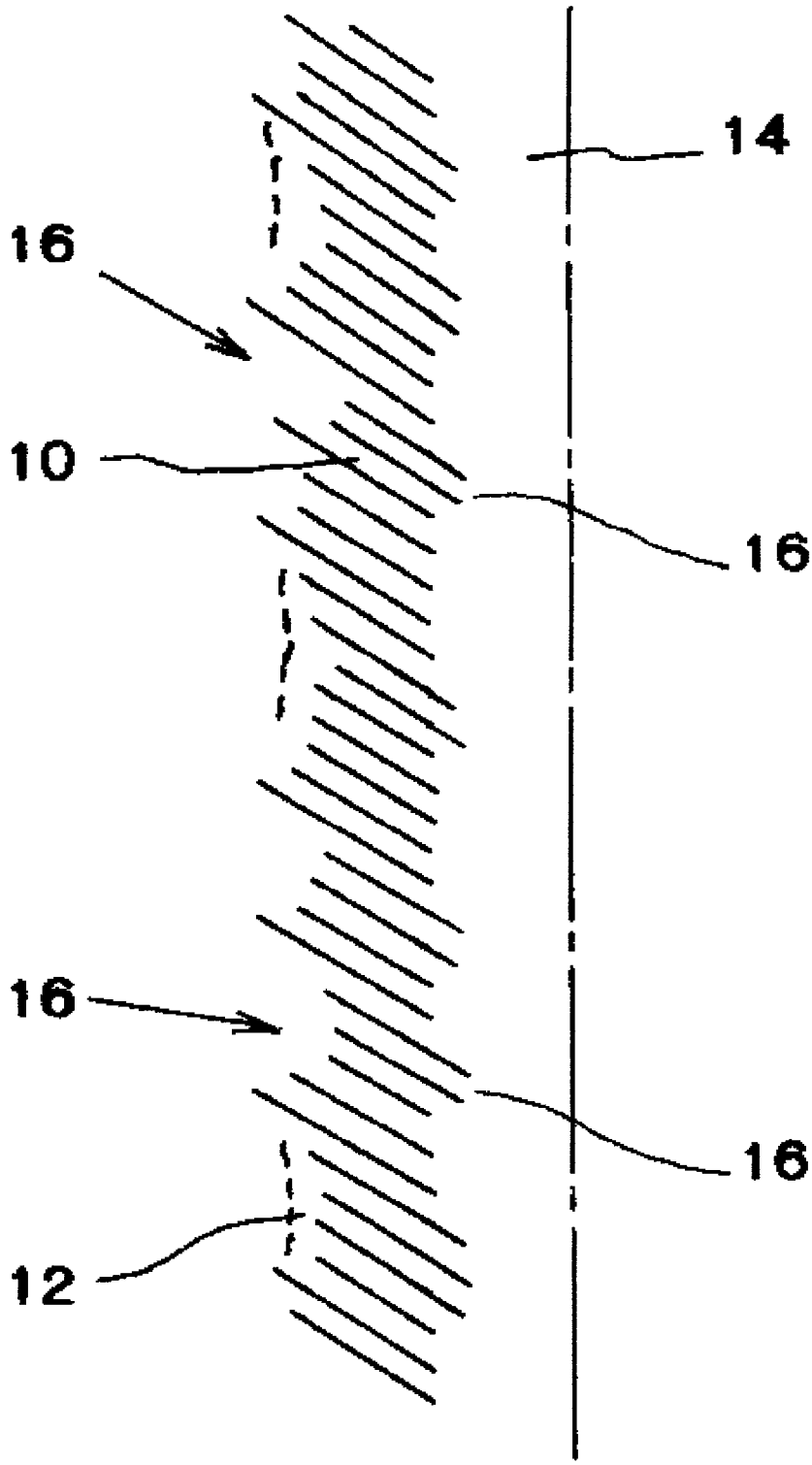
FIG. 7 is a schematic view of FIG. 6.

As is clear from FIGS. 5 to 7, part of the deposited layers 12 is removed by performing a heat treatment or the like, whereby the edges of the hexagonal carbon layers 10 are further exposed. The residual deposited layers 12 are considered to be almost pyrolyzed and merely attached to the carbon fiber. The deposited layers 12 can be removed completely by combining heat treatment for several hours and washing with supercritical water.

As is clear from FIG. 4, the carbon fiber 1 in which a number of hexagonal carbon layers 10 in the shape of a bottomless cup are stacked is hollow at a length ranging at least from several tens of nanometers to several tens of microns.

The tilt angle of the hexagonal carbon layers with respect to the center line is from about 25° to 35°.

As is clear from FIGS. 6 and 7, the edges of the hexagonal carbon layers 10 on the outer surface and the inner surface are irregular in the area in which the edges of the hexagonal carbon layers 10 are exposed, whereby minute irregularities 16 at a nanometer (nm) level, specifically, at a level of the size of atoms are formed. The irregularities 16 are unclear before removing the deposited layers 12 as shown in FIG. 2. However, the irregularities 16 appear by removing the deposited layers 12 by the heat treatment.

The exposed edges of the hexagonal carbon layers 10 have an extremely high degree of activity and easily bond to other atoms. The reasons therefor are considered to be as follows. The heat treatment in air causes the deposited layers 12 to be removed and the number of functional groups containing oxygen such as a phenolic hydroxyl group, carboxyl group, quinone type carbonyl group, and lactone group to be increased on the exposed edges of the hexagonal carbon layers 10. These functional groups containing oxygen have high hydrophilicity and high affinity to various types of substances.

In addition, the hollow structure and the irregularities 16 contribute to anchoring effects to a large extent.

As shown in FIG. 7, the inner and outer edges of the cyclic hexagonal carbon layers 10 are exposed on the inner and outer surfaces of the carbon fiber. All the exposed edges function as electron emission tips, whereby a large amount of emission current can be obtained.

Moreover, since the exposed edges of the hexagonal carbon layers 10 are irregular and form minute irregularities 16 at a level of the size of atoms, an electric field is more easily concentrated on the exposed edges of the hexagonal carbon layers, whereby a necessary strong field can be obtained.

A cold cathode of a light emitting device can be formed by mixing the carbon fibers thus obtained with a base material such as a heat-resistant resin and applying a large number of carbon fibers on a substrate in the same direction using a screen printing process or the like (not shown).

Figure 8:
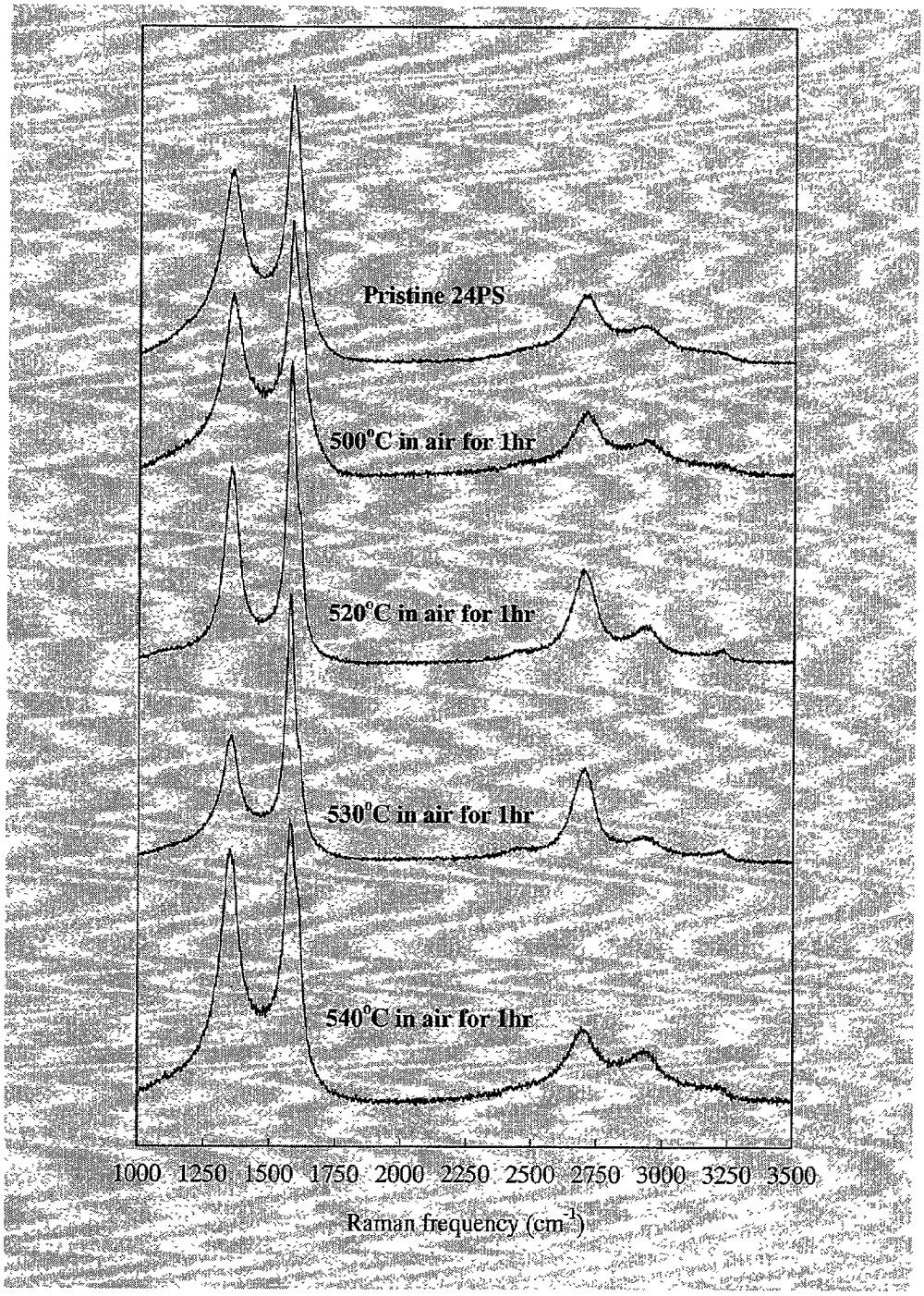
FIG. 8 shows Raman spectra of a carbon fiber having a herring-bone structure (sample No. 24PS) after heating at 500° C., 520° C., 530° C., and 540° C. for one hour in air.

FIG. 8 shows Raman spectra of a carbon fiber having a herring-bone structure (sample No. 24PS) after heating at 500° C., 520° C., 530° C., and 540° C. for one hour in air.

FIGS. 5 to 7 show that the deposited layers 12 are removed by the heat treatment. As is clear from the Raman spectra shown in FIG. 8, the presence of a D peak (1360 $cm^{-1}$) and a G peak (1580 $cm^{-1}$) shows that this sample is a carbon fiber and has no graphitized structure.

Specifically, the carbon fiber having a herring-bone structure is considered to have a turbostratic structure in which hexagonal planes are displaced.

This carbon fiber has a turbostratic structure in which hexagonal planes are stacked in parallel but are shifted in the horizontal direction or rotated. Therefore, the carbon fiber has no crystallographic regularity.

Figure 9:
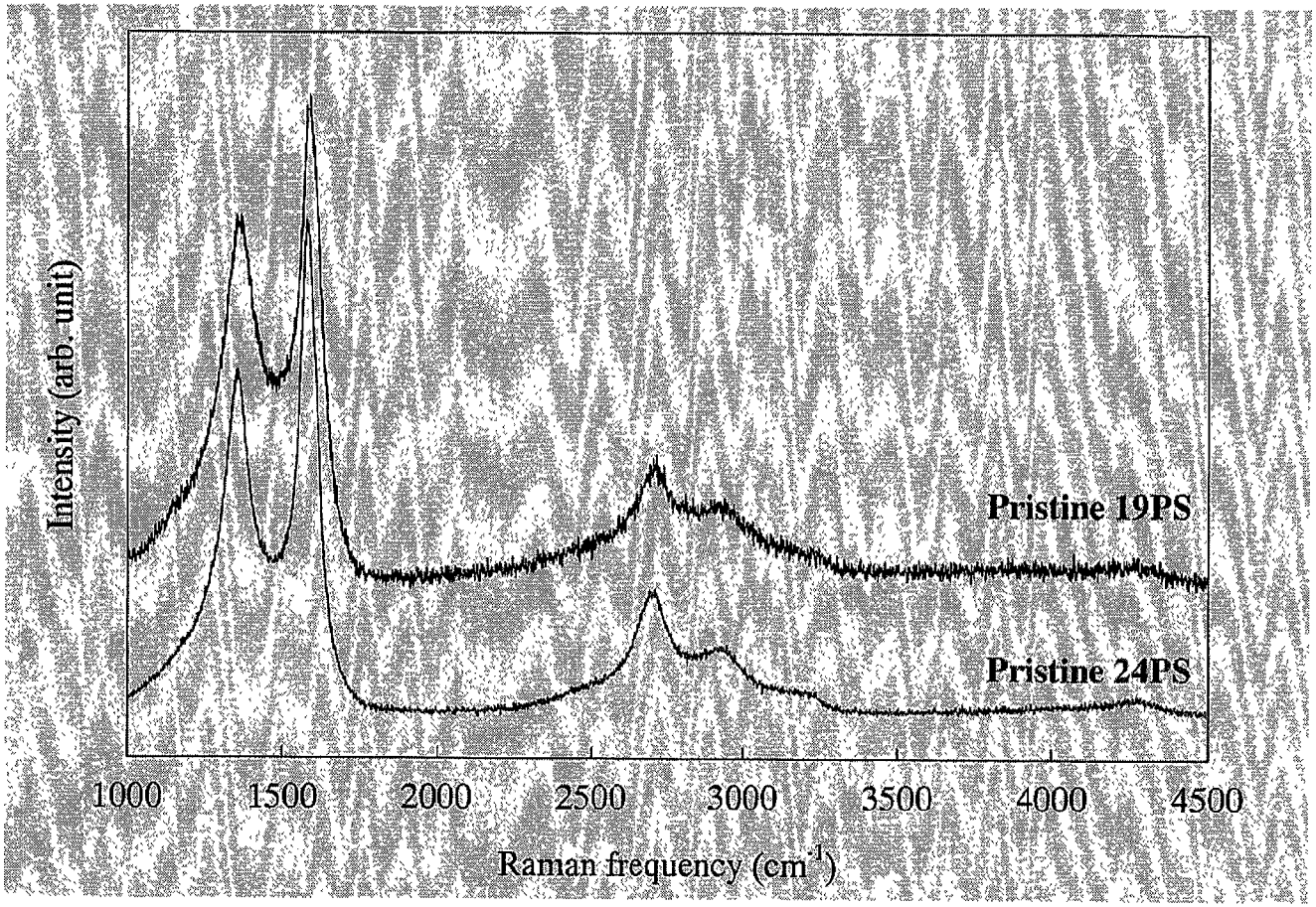
FIG. 9 shows Raman spectra of carbon fiber samples No. 19PS and No. 24PS in which the edges of the hexagonal carbon layers are exposed by the above heat treatment.

FIG. 9 shows Raman spectra of carbon fiber samples No. 19PS and No. 24PS in which the edges of the hexagonal carbon layers are exposed by the above heat treatment.

Figure 10:
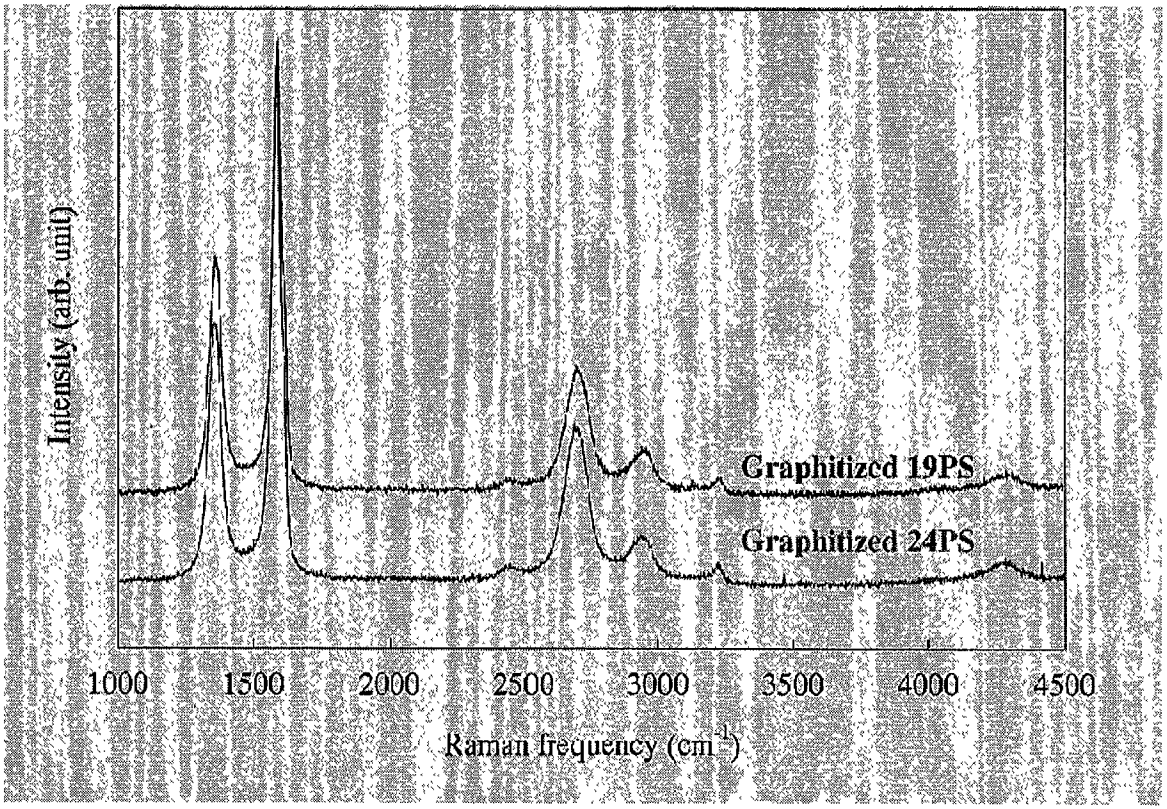
FIG. 10 is a view showing Raman spectra of the carbon fiber samples No. 19PS and No. 24PS, in which the edges of the hexagonal carbon layers are exposed, after heating at 3000° C.

FIG. 10 shows Raman spectra of the carbon fiber samples No. 19PS and No. 24PS, in which the edges of the hexagonal carbon layers are exposed, after heating at 3000° C. (common graphitization treatment).

As shown in FIG. 10, the D peak does not disappear even if the carbon fiber in which the edges of the hexagonal carbon layers are exposed is subjected to the graphitization treatment. This means that the carbon fiber is not graphitized by the graphitization treatment.

A diffraction line did not appear at the 112 plane in X-ray diffractometry (not shown). This also shows that the carbon fiber was not graphitized.

It is considered that the carbon fiber is not graphitized by the graphitization treatment because the deposited layers 12, which are easily graphitized, have been removed. This also shows that the remaining portions of the herring-bone structure are not graphitized.

The fact that the carbon fiber is not graphitized at a high circumferential temperature means that the carbon fiber is thermally stable.

A carbon fiber in which several to several hundreds of hexagonal carbon layers are stacked obtained by dividing the above carbon fiber may be used as the carbon fiber for a field electron emitter.

The carbon fiber may be divided by adding an appropriate amount of water or solvent and grinding the carbon fiber slowly using a mortar and pestle.

Specifically, the carbon fiber (in which the deposited layers 12 may be formed, or part or all of the deposited layers 12 may be removed) is placed in a mortar, and ground mechanically and slowly using a pestle.

The carbon fiber product in which several to several hundreds of hexagonal carbon layers are stacked can be obtained by experimentally determining the treatment time in a mortar.

The cyclic hexagonal carbon layers have a comparatively high strength and are bonded to one another by only a weak Van der Waals force. Therefore, the cyclic hexagonal carbon layers are separated without being crushed between layers in which the bond is particularly weak.

It is preferable to grind the carbon fiber using a mortar and pestle in liquid nitrogen. Water in air is absorbed when liquid nitrogen is evaporated and becomes ice. Therefore, the carbon fiber can be separated between the above unit fiber layers while reducing mechanical stress by grinding the carbon fiber together with ice using a mortar and pestle.

Figure 11:
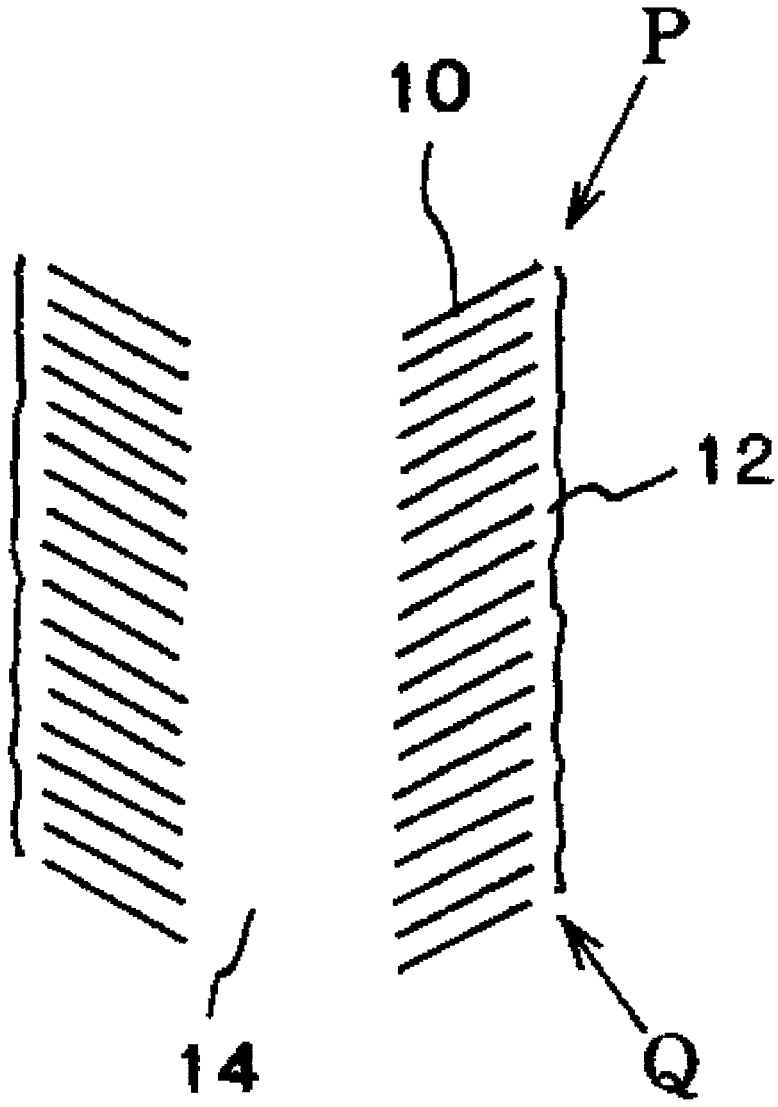
FIG. 11 is a view showing a carbon fiber product obtained by dividing a carbon fiber covered with a deposited layer.

FIG. 11 is a view showing a carbon fiber obtained by dividing the short fiber covered with the deposited layers 12. The cyclic edges (large ring ends) P and Q of the hexagonal carbon layers 10 on opposite ends are exposed by separation, even if the short fiber is covered with the deposited layers 12.

The deposited layers 12 adhering to the outer circumference of the middle hexagonal carbon layers 10 may be removed by mechanical stress applied by a pestle, whereby the edges of the middle hexagonal carbon layers 10 may be exposed. The deposited film adhering to the inner circumference of the hexagonal carbon layers 10 (not shown in FIG. 11) can also be removed.

Figure 12:
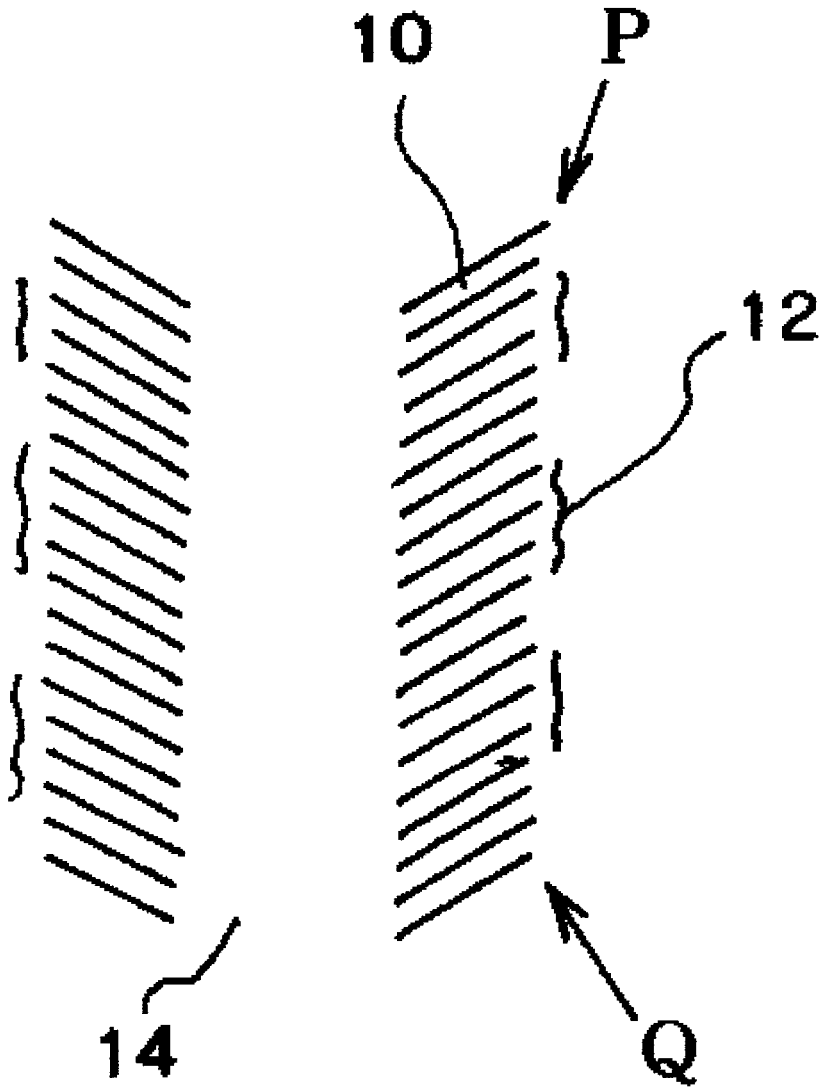
FIG. 12 is a view showing a carbon fiber product obtained by dividing a carbon fiber in which edges of hexagonal carbon layers are exposed in advance by heat treatment.

FIG. 12 is a view showing a carbon fiber obtained by dividing the short fiber in which the edges of the hexagonal carbon layers 10 are exposed in advance by heat treatment.

In this case, not only the cyclic edges P and Q on the opposite ends, but also the inner and outer edges of the middle hexagonal carbon layers 10 are exposed, whereby the degree of activity is further increased.

The carbon fiber is preferably ground by ball milling on an industrial scale.

An example in which the length of the carbon fiber was adjusted by ball milling is described below.

A ball mill manufactured by Kabushikigaisha Asahi Rika Seisakujo was used.

Balls used were made of alumina with a diameter of 5 mm. 1 g of the above carbon fiber, 200 g of alumina balls, and 50 cc of distilled water were placed in a cell, and treated at a rotational speed of 350 rpm. The carbon fiber was sampled when 1, 3, 5, 10, and 24 hours had elapsed.

Figure 13:
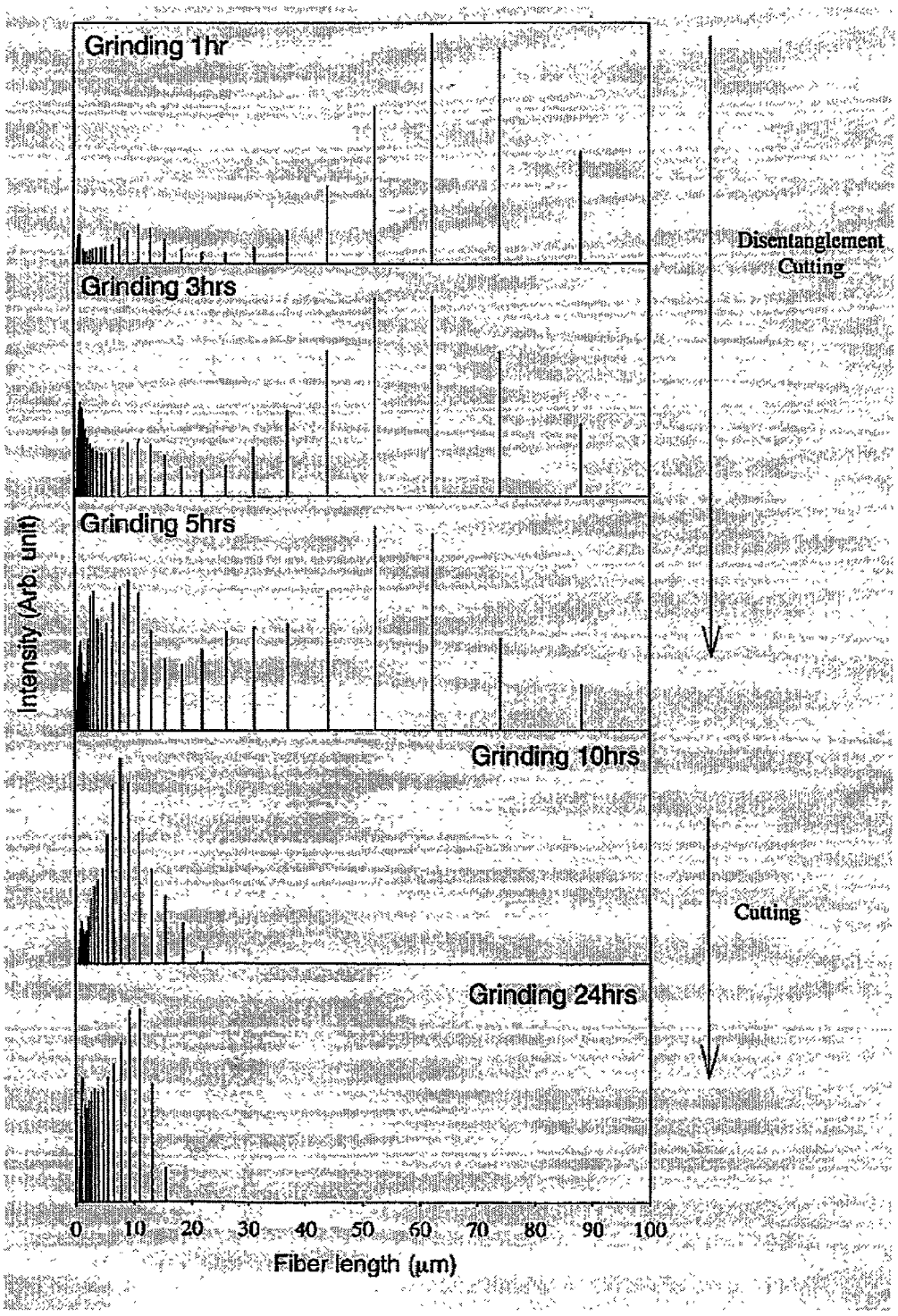
FIG. 13 is a graph showing distributions of the length of the carbon fiber with the passage of time at the time of grinding by ball milling.

FIG. 13 shows distributions of the length of the carbon fiber measured using a laser particle size distribution analyzer at each sampling time.

As is clear from FIG. 13, the fiber length is decreased with the passing of milling time. In particular, the fiber length is decreased rapidly to 10 μm or less after 10 hours have elapsed. Another peak appears at about 1 μm after 24 hours have elapsed. This clearly shows that the fiber length was further decreased. The reason why the peak appears at about 1 μm is considered to be because the length almost equals the diameter, whereby the diameter is counted as the length.

Figure 14:
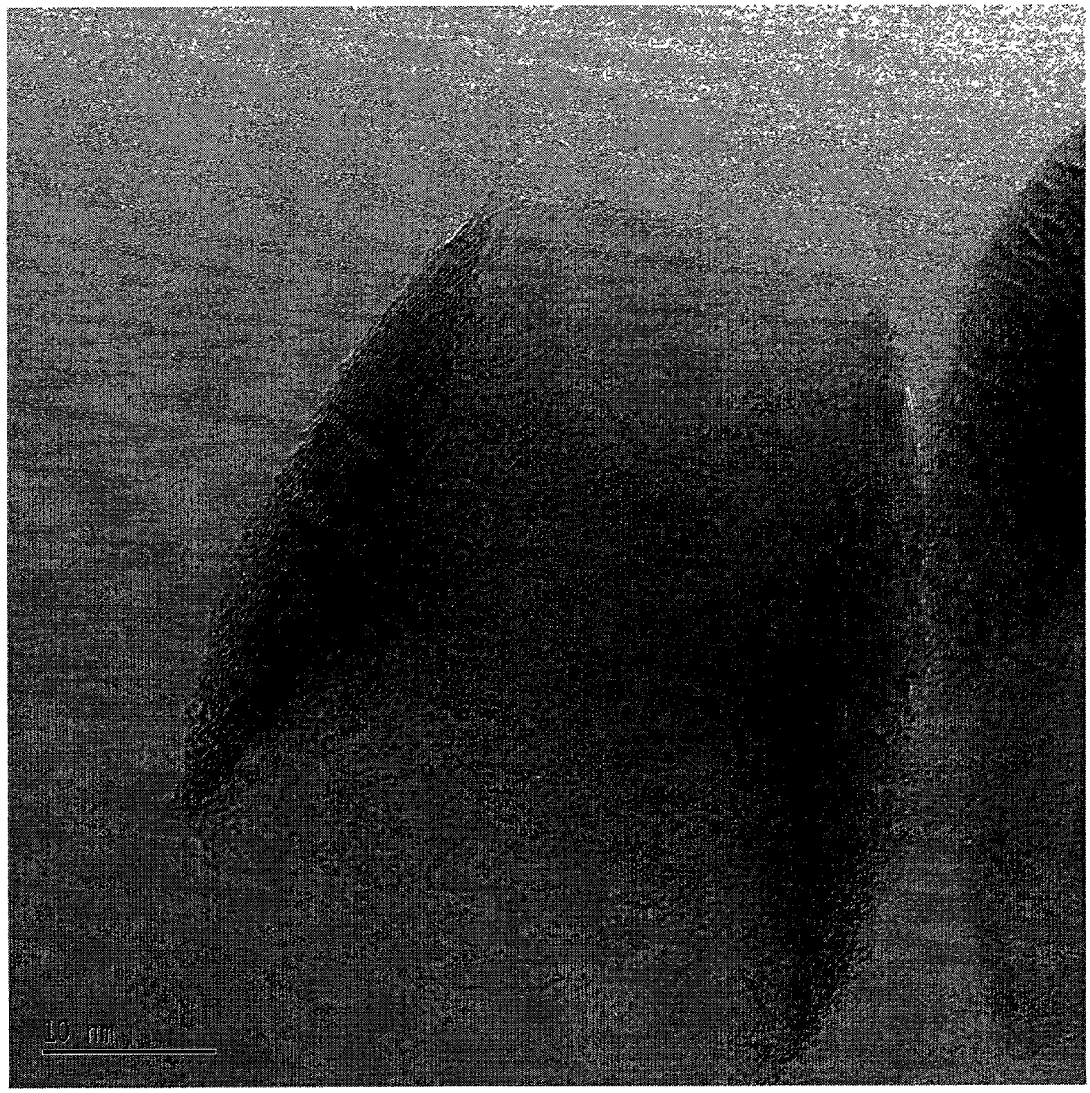
FIG. 14 is a view showing a copy of a transmission electron micrograph showing a state in which the carbon fiber is divided into a carbon fiber product in which several tens of bottomless cup-shaped hexagonal carbon layers are stacked.

FIG. 14 is a view showing a copy of a transmission electron micrograph of a very interesting carbon fiber of which the length is adjusted in a state in which several tens of bottomless cup-shaped hexagonal carbon layers are stacked. The carbon product has a hollow shape with no bridge. The edges of the hexagonal carbon layers are exposed on the outer surface side and the inner surface side of the hollow portion. This carbon fiber is in the shape of a tube with a length and a diameter of about 60 nm which has a thin wall and a large hollow portion. The length of the carbon fiber may be adjusted by changing the ball milling conditions or the like.

The carbon fiber product is divided as a result of falling from the bottomless cup-shaped hexagonal carbon layer. Therefore, the shape of the hexagonal carbon layers is not damaged.

In the case where a conventional concentric carbon nanotube is ground, breakage of the tube may cause cracks on the outer surface in the axial direction or fine split. Moreover, the core may come off. Therefore, it is difficult to adjust the length.

As described above, the exposed edges of the hexagonal carbon layers 10 have an extremely high degree of activity and easily bond to other atoms. The reasons therefor are considered to be as follows. The heat treatment in air causes the deposited layers 12 to be removed and the number of functional groups containing oxygen such as a phenolic hydroxyl group, carboxyl group, quinone type carbonyl group, and lactone group to be increased on the exposed edges of the hexagonal carbon layers. These functional groups containing oxygen have high hydrophilicity and high affinity to various types of substances.

In addition, the hollow structure and the irregularities 16 contribute to anchoring effects to a large extent.

In the carbon fiber shown in FIG. 14, several tens to several hundreds of hexagonal carbon layers in the shape of a bottomless cup are stacked. Since all the edges of the hexagonal carbon layers on the inner and outer surfaces of the tube-shaped fiber function as electron emission tips, a large amount of emission current can be obtained.

Figure 15:
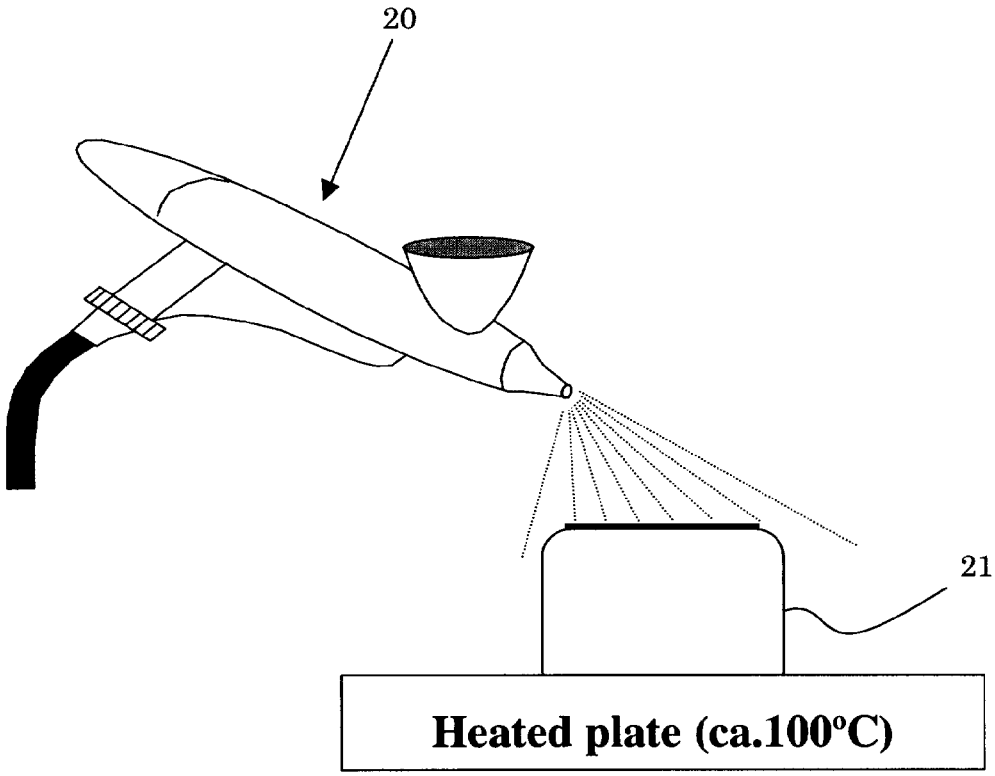
FIG. 15 is a view showing a case of manufacturing an emitter using a spray process.

FIG. 15 is a view showing a method for manufacturing an emitter using the carbon fiber of which the length is adjusted shown in FIG. 14.

Specifically, the above carbon fibers were dispersed in ethanol by applying ultrasonic waves. The carbon fibers were deposited on the surface of a column-shaped cathode base 21 (diameter: 5 mm, height: 5 mm) made of a stainless steel heated at about 100° C. by blowing the carbon fibers using an air brush (spray) 20. The carbon fibers were then dried to obtain an emitter. Adhesion of the carbon fiber is improved by forming a buffer layer (not shown) such as nickel or a gold layer in advance on the surface of the cathode base 21 by vapor deposition, sputtering, or the like.

Figure 16:
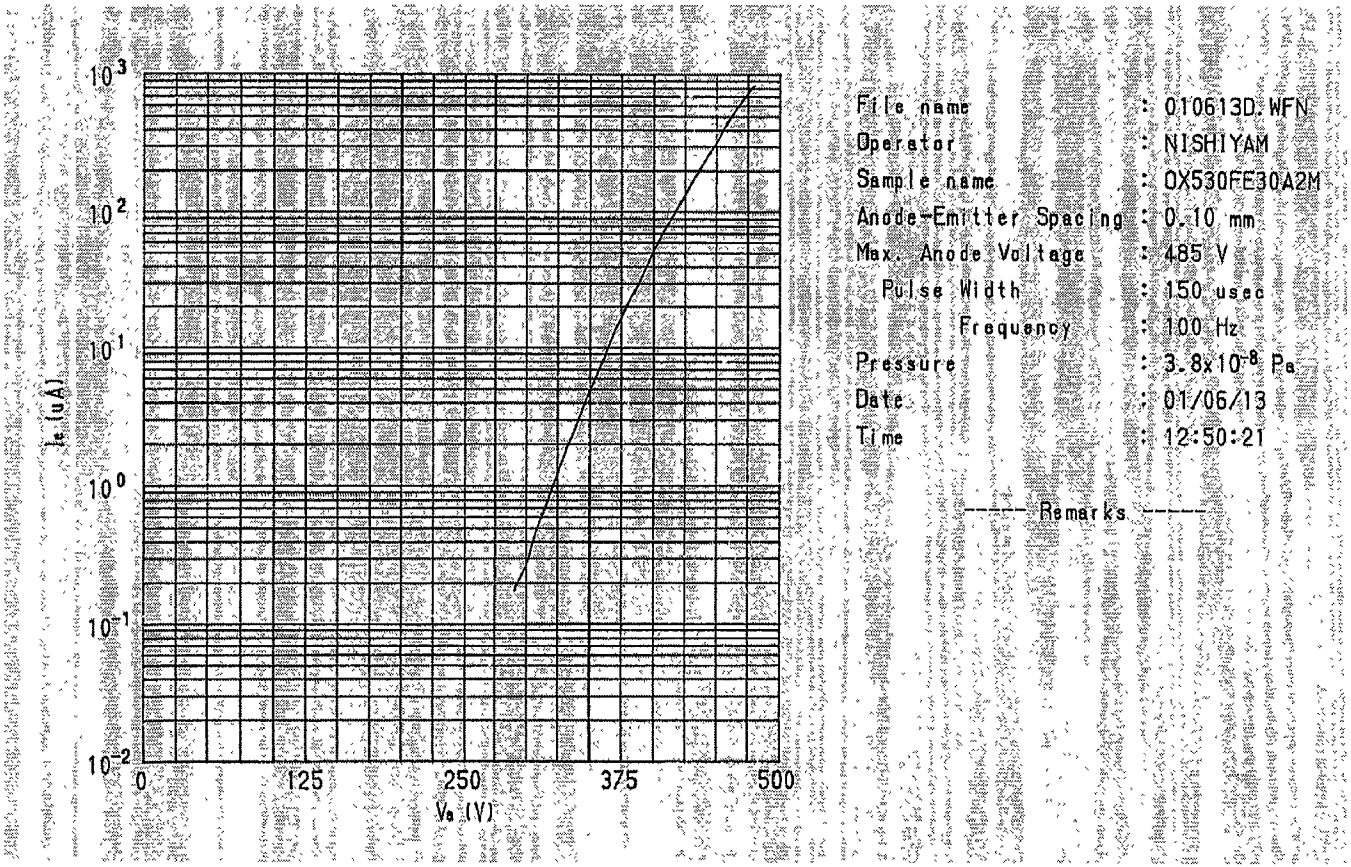
FIG. 16 is a graph showing discharge starting voltage characteristics of field emission of an emitter formed using a carbon fiber of the present embodiment.
Figure 17:
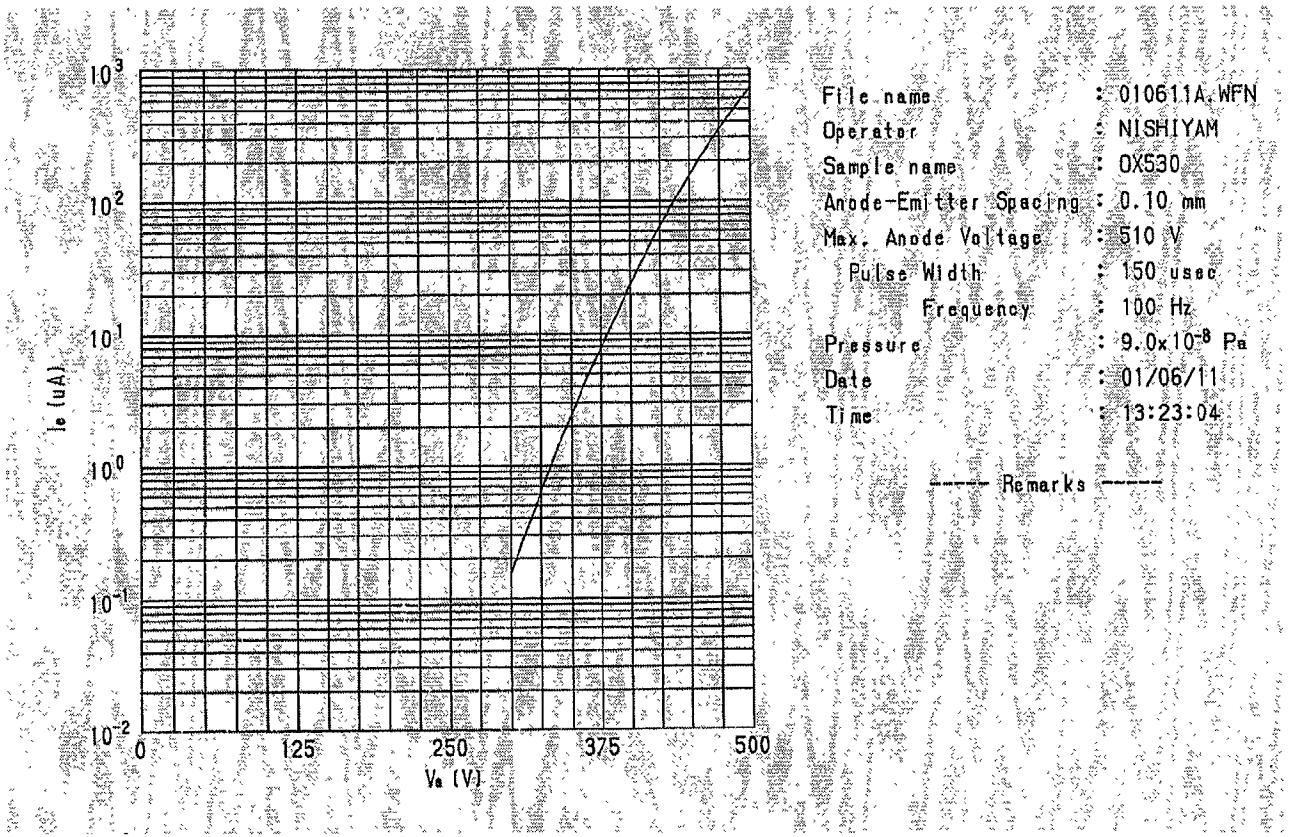
FIG. 17 is a graph showing discharge starting voltage characteristics of field emission of an emitter formed using a carbon fiber of the present embodiment.

FIGS. 16 and 17 show discharge starting voltages when causing field emission using the emitter formed in the above manner. FIG. 16 shows the case of forming a carbon fiber layer on the buffer layer, and FIG. 17 shows the case of forming the carbon fiber layer directly on stainless steel. The discharge starting voltage of the former was 485 V. The discharge starting voltage of the latter was 510 V.

Figure 18:
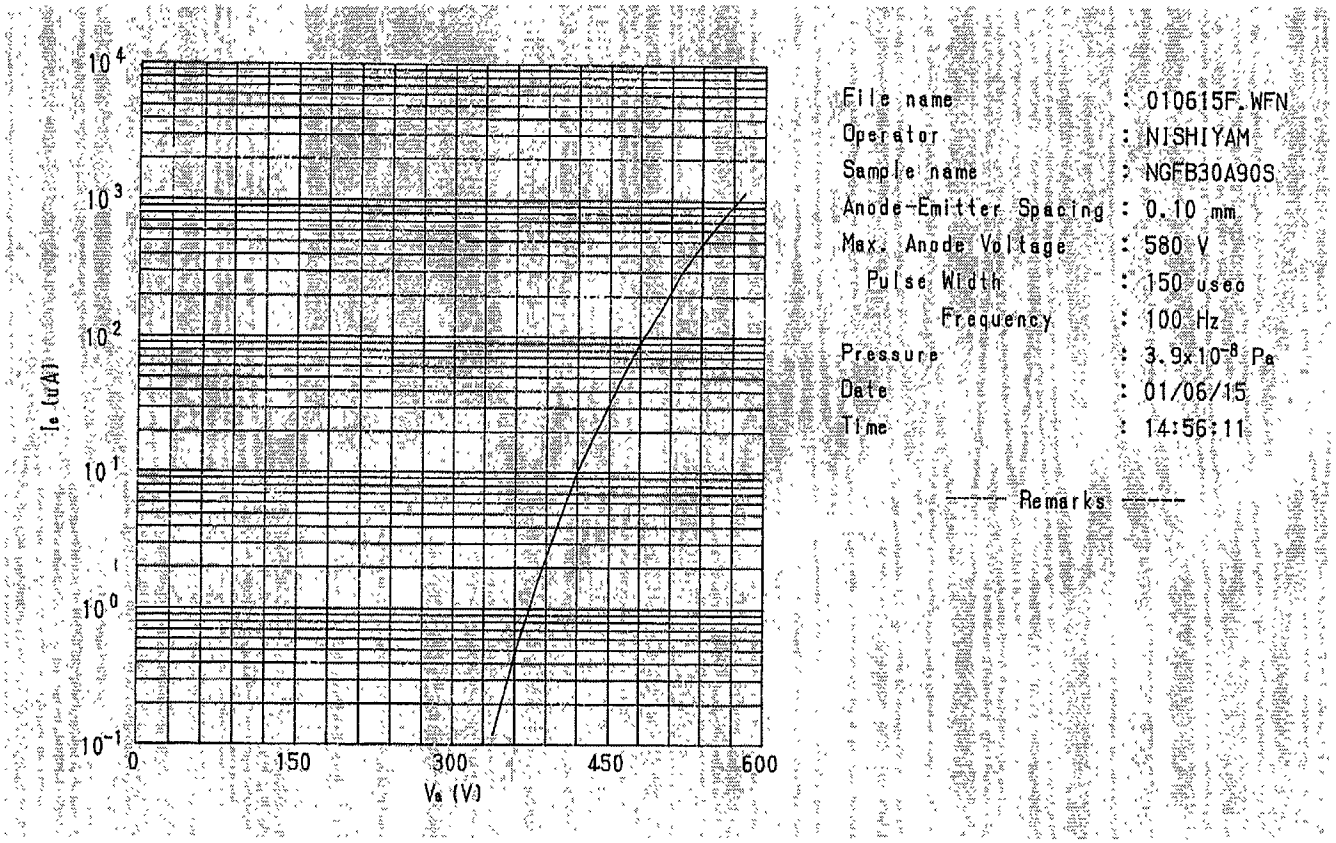
FIG. 18 is a graph showing discharge starting voltage characteristics of field emission of an emitter formed using a conventional carbon nanotube.
Figure 19:
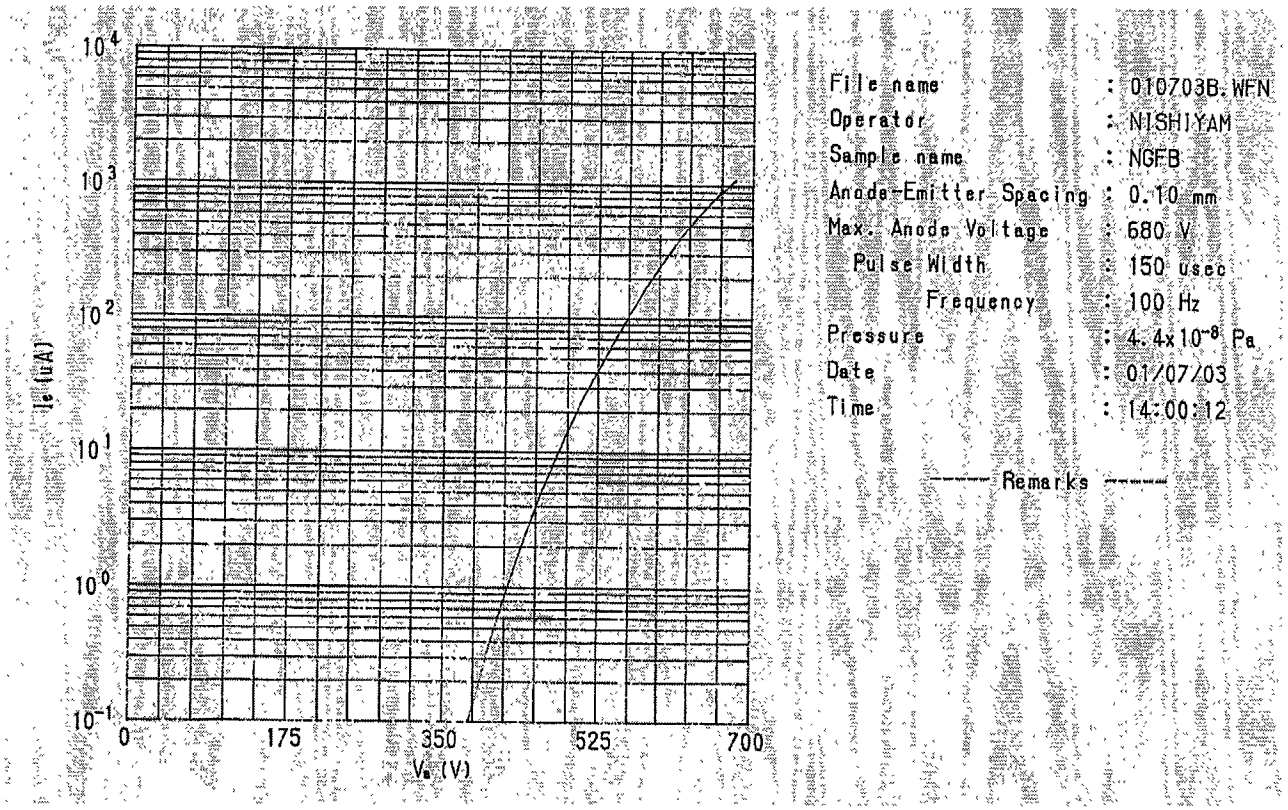
Prior Art FIG. 19
FIG. 19 is a graph showing discharge starting voltage characteristics of field emission of an emitter formed using a conventional carbon nanotube.

FIGS. 18 and 19 show discharge starting voltages in the case of using a conventional carbon nanotube (concentric carbon fiber) as a cathode material. FIG. 18 shows the case of forming the carbon fiber layer on the buffer layer, and FIG. 19 shows the case of forming the carbon fiber layer directly on stainless steel. The discharge starting voltage of the former was 580 V. The discharge starting voltage of the latter was 680 V.

As is clear from the above results, discharge commenced at a lower voltage in the case of using the carbon fiber of the present embodiment as the electrode material. Since the discharge starts at a lower voltage in comparison with a conventional emitter, power consumption can be decreased. Moreover, damage to the electrode can be reduced, whereby lifetime characteristics can be improved. Furthermore, a larger amount of emission current can be obtained at the same voltage.

According to the carbon fiber for a field electron emitter of the present embodiment, since the cyclic edges P of the hexagonal carbon layers are exposed on the outer surface and all the exposed edges function as electron emission tips, a large amount of emission current can be obtained.

Moreover, since the exposed edges of the hexagonal carbon layers are irregular and form minute irregularities at a level of the size of atoms, an electric field is more easily concentrated on the exposed edges of the hexagonal carbon layers, whereby a necessary strong field can be obtained.

What is claimed is:

1. A stacked cup carbon nanofiber for a field electron emitter comprising:

a coaxial stacking morphology of vapor grown truncated conical tubular graphene layers, each of which includes a hexagonal carbon layer in the shape of a hollow cup not having a bottom, and has a large ring end and a small ring end at opposite ends in an axial direction, wherein edges of the hexagonal carbon layers are exposed on at least a portion of the large ring ends by removing a deposited film of an excess amount of pyrolytic carbon formed during vapor growth, wherein the exposed edges function as electron emission tips, and wherein the stacked cup carbon nanofiber has a round cross-section.

2. The stacked cup carbon nanofiber for a field electron emitter according to claim 1, wherein the edges of the hexagonal carbon layers are exposed on at least a portion of the small ring ends by removing the deposited film formed during vapor growth.

3. The stacked cup carbon nanofiber for a field electron emitter according to claim 1, wherein the large ring ends of the truncated conical graphene tubular layers are stacked in the axial direction to form an outer surface of the stacked cup carbon nanofiber, and wherein the edges of the hexagonal carbon layers are exposed on 2% or more of the outer surface.

4. The stacked cup carbon nanofiber for a field electron emitter according to claim 3, wherein the large ring ends of the truncated conical graphene tubular layers are irregularly positioned on the outer surface, so that the outer surface has minute irregularities at a level of the size of atoms.

5. The stacked cup carbon nanofiber for a field electron emitter according to claim 1, wherein the small ring ends of the truncated conical graphene tubular layers are stacked in the axial direction to form an inner surface of the stacked cup carbon nanofiber, and wherein the small ring ends are irregularly positioned on the inner surface of the stacked cup carbon nanofiber, so that the inner surface has minute irregularities at a level of the size of atoms.

6. The stacked cup carbon nanofiber for a field electron emitter according to claim 1, wherein several to several hundreds of the hexagonal carbon layers are stacked.

7. A method for manufacturing a field electron emitter comprising the steps of:

dispersing the stacked cup carbon nanofibers for a field electron emitter according to claim 1 in a dispersion medium;

depositing the stacked cup carbon nanofibers on an electrode by spraying; and drying the stacked cup carbon nanofibers to form a carbon fiber layer.

8. The method according to claim 7 further comprising the steps of forming a metal buffer layer on the electrode in advance, and forming the carbon fiber layer on the metal buffer layer.

* * * * *